US010107462B1

(12) United States Patent
Loomis

(10) Patent No.: US 10,107,462 B1
(45) Date of Patent: Oct. 23, 2018

(54) EXPANDABLE LIGHT STRING

(71) Applicant: Seasons 4, Inc., Toano, VA (US)

(72) Inventor: Jason Loomis, Decatur, GA (US)

(73) Assignee: Seasons 4, Inc., Toano, VA (US)

( * ) Notice: Subject to any disclaimer, the term of this patent is extended or adjusted under 35 U.S.C. 154(b) by 0 days.

(21) Appl. No.: 15/967,060

(22) Filed: Apr. 30, 2018

Related U.S. Application Data

(63) Continuation-in-part of application No. 15/608,699, filed on May 30, 2017, now Pat. No. 9,982,853.

(51) Int. Cl.

| | |
|---|---|
| ***F21S 4/10*** | (2016.01) |
| ***F21S 4/20*** | (2016.01) |
| ***F21V 23/06*** | (2006.01) |
| ***F21S 4/22*** | (2016.01) |
| *F21Y 115/10* | (2016.01) |

(52) U.S. Cl.
CPC . *F21S 4/10* (2016.01); *F21S 4/22* (2016.01); *F21V 23/06* (2013.01); *F21Y 2115/10* (2016.08)

(58) Field of Classification Search
CPC ..... F21S 4/10; F21S 4/20; Y10S 362/806
See application file for complete search history.

(56) References Cited

U.S. PATENT DOCUMENTS

| | | | |
|---|---|---|---|
| 6,497,497 | B1 | 12/2002 | Ahroni |
| 6,527,413 | B1 | 3/2003 | McIngvale |
| 7,055,981 | B2 | 6/2006 | Yao |
| 7,837,351 | B2 | 11/2010 | Lin |
| 2015/0292721 | A1 | 10/2015 | Lesmeister et al. |

*Primary Examiner* — Joseph L Williams
(74) *Attorney, Agent, or Firm* — Kinney & Lange, P.A.

(57) ABSTRACT

Apparatus and associated methods relate to a light string having pluralities of lighting elements and one or more expandable links thereon, so as to facilitate expansion of the light string in response to applied tensile forces. The one or more expandable links includes a segment of flexible cable and an expansion member mechanically engaging the segment of the flexible cable. The one or more expandable links is in a natural state if no tensile force is applied between the first and second ends of the light string and in an expanded state if a tensile force is applied between the first and second ends of the light string. In the natural state, an arcuate portion of the flexible cable is between the first and the second ends of the light string. The arcuate portion of the flexible cable changes shape in response to an applied tensile force applied therebetween.

20 Claims, 8 Drawing Sheets

EXPANDABLE LIGHT STRING

CROSS-REFERENCE TO RELATED APPLICATION(S)

This application is a continuation in part of U.S. patent application Ser. No. 15/608,699, entitled "EXPANDABLE LIGHT STRING" filed May 30, 2017 by Jason Loomis, which is hereby incorporated by reference.

BACKGROUND

Decorative light strings are used to communicate a joy of a holiday season, to draw attention to merchandise, or to simply decorate or adorn an object. Decorative light strings can be used both indoors and outdoors. Decorative light strings have been used residentially to adorn trees, shrubs, and houses. Commercial businesses can use decorative light strings to provide festive atmospheres at their places of business.

Often light strings are placed on trees and shrubs shortly before a festival and/or holiday season, and then removed after the festival and/or holiday season has ended. Trees and shrubs grow very little during the time span of the festival and/or holiday season. If, however, the light strings were left adorning the trees and shrubs for longer periods of time, the natural growth of trees and shrubs can cause tensile forces along the length of the light strings, and/or constrict the trees and shrubs. Such tensile forces can result in death of the trees and shrubs and or destruction of the light strings if the forces are not reduced in a sufficient time.

This disclosure is directed to providing elastic expansion capabilities to decorative light strings, so as to permit the decoration of such things that can have the possibility of applying tensile forces to the decorative light string.

SUMMARY

Apparatus and associated methods relate to an expandable light string. The expandable light string includes a flexible cable having a plurality of conductive wires extending and providing electrical conduction between a first electrical connector at a first end and a complementary second electrical connector at a second end. The first electrical connector is configured to receive operating power and the complementary second electrical connector configured to provide operating power. The expandable light string includes a plurality of lighting elements distributed on the flexible cable. Each of the plurality of lighting elements is configured to illuminate in response to receiving operating power from the plurality of conductive wires. The expandable light string includes one or more expansion members coupled to the flexible cable. The one or more expansion members is configured to expand, in response to a tensile force applied to the first and second ends of the flexible cable, so that a length of the flexible cable between the first and second ends increases, and to contract, in response to a reduction in the tensile force applied to the first and second ends of the flexible cable, so that the length of the flexible cable between the first and second ends decreases.

Some embodiments relate an expandable light string. The expandable light string includes a flexible cable having a plurality of conductive wires extending and providing electrical conduction between a first electrical connector at a first end and a complementary second electrical connector at a second end, The first electrical connector is configured to receive operating power and the complementary second electrical connector configured to provide operating power. The expandable light string includes a plurality of lighting elements distributed on the flexible cable. Each of the plurality of lighting elements is configured to illuminate in response to receiving operating power from the plurality of conductive wires. The expandable light string also includes one or more expandable links. Each of the one or more expansion lights includes a segment of the flexible cable and an expansion member mechanically engaging the segment of the flexible cable. Each of the one or more expandable links is in a natural state if no tensile force is applied between opposite ends of the expandable link and in an expanded state if a tensile force is applied between the opposite ends of the expandable link. In the natural state, the expansion member maintains the flexible cable in an arcuate form between the first and the second engagement portions.

DETAILED DESCRIPTION

Apparatus and associated methods relate to a light string having pluralities of lighting elements and expandable links thereon, so as to facilitate expansion of the light string in response to applied tensile forces. Each of the expandable links includes a segment of flexible cable between an adjacent pair of the lighting elements and an expansion member mechanically engaging the segment of the flexible cable at first and second engagement portions. Each of the expandable links is in a natural state if no tensile force is applied between the first and second engagement portions and in an expanded state if a tensile force is applied between the first and second engagement portions. In the natural state, an arcuate portion of the flexible cable is between the first and the second engagement portions. The arcuate portion of the flexible cable changes shape in response to an applied tensile force applied therebetween.

Figure 1:
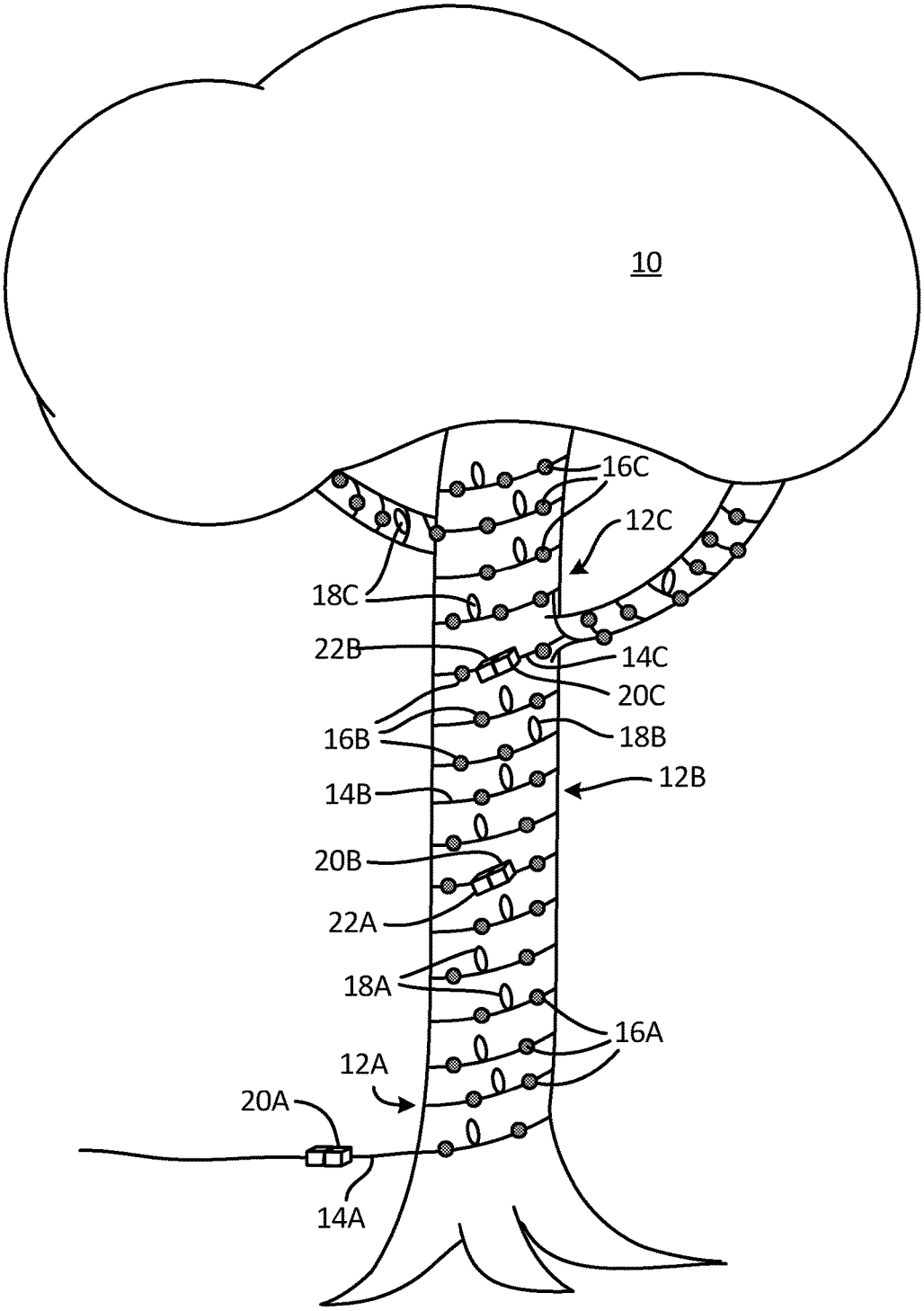
FIG. 1 is a schematic view of a tree decorated with an expandable light string.

FIG. 1 is a schematic view of a tree decorated with an expandable light string. In FIG. 1, tree 10 has been decorated with series connected expandable light strings 12A, 12B and 12C. Each of expandable light strings 12A, 12B and 12C includes a flexible cable 14A, 14B, 14C, a plurality of lighting elements 16A, 16B, 16C and a plurality of expandable links 18A, 18B, 18C, respectively. Flexible cables 14A, 14B and 14C extend between first electrical connectors 20A, 20B and 20C at first ends and complementary second electrical connectors 22A, 22B and 22C at second ends of expandable light strings 12A, 12B and 12C, respectively.

Each of flexible cables 14A-14C includes two or more conductive wires so as to provide electrical conduction between first electrical connectors 20A-20C and complementary second electrical connectors 22A-22C, respectively. First electrical connectors 20A-20C are configured to receive operating power from sources connected thereto. Second electrical connectors 22A-22C are configured to provide operating power to other expandable light strings and/or electrical devices connected thereto. First and second electrical connectors 20A-20C and 22A-22C are complementary one to another, so as to facilitate the depicted series connection of expandable light strings.

The plurality of lighting elements 16A-16C is distributed on flexible cables 12A-12C. Each of the plurality of lighting elements 16A-16C is configured to illuminate in response to receiving operating power from the plurality of conductive wires in flexible cables 12A-12C. In some embodiments, lighting elements 16A-16C include incandescent bulbs. In some embodiments, lighting elements 16A-16C include Light Emitting Diodes (LEDs).

Each of the plurality of expandable links 18A-18C is configured to facilitate expansion of expandable light strings 12A-12C. Flexible cables 14A-14C can have a high tensile strength so as to provide good resistance to expansion. For example, a 14 gauge copper wire can have a tensile strength of 70 pounds. If more than 70 pounds of force is applied, the 14 gauge copper wire can break. Flexible cables 14A-14C can have two, three, or more conductive wires extending between connectors 22A-22C. The tensile strength of flexible cables 14A-14C increases as the number of conductive wires extending between connectors 22A-22C increases. But the tensile strength of flexible cables 14A-14C decreases as the diameter of the conductive wires extending between connectors 22A-22C decreases. If, for example, each of flexible cables 14A-14C has three 20 gauge conductive wires of 28 pound tensile strengths extending between connectors 22A-22C, the total tensile strength will be around 84 pounds. In some embodiments, the tensile strength of flexible cables 14A-14C is at least 25 Newtons, 50, 75, 100 or 200 Newtons or more. Such high-tensile-strength flexible cables typically do not expand very much in response to tensile forces that are less than the tensile strength of the flexible cable.

Figure 2A:
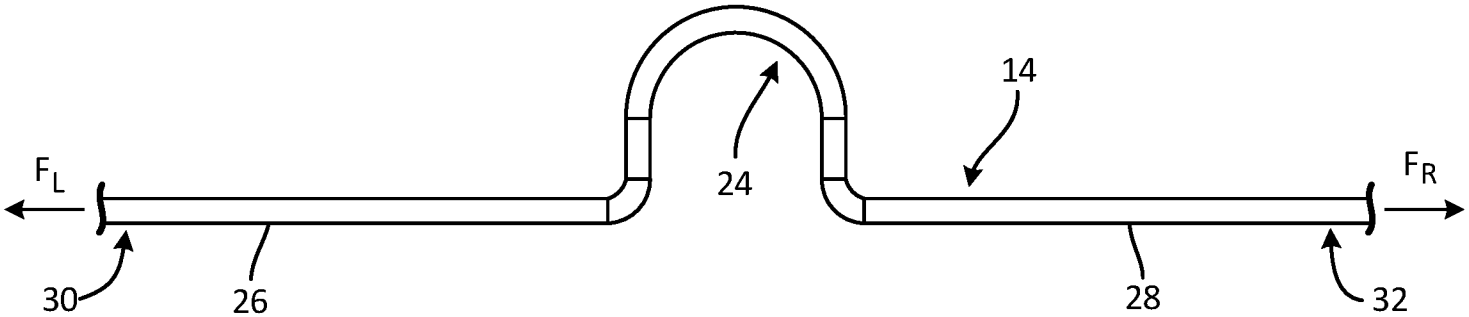
FIG. 2A is a schematic diagram of a flexible cable having an arcuate portion which can expand in response to a tensile force.

FIG. 2A is a schematic diagram of a flexible cable having an arcuate portion which can expand in response to a tensile force. In FIG. 2A, exemplary flexible cable 14 includes arcuate portion 24. Arcuate portion 24 connects first straight section 26 and second straight section 28. Arcuate portion 24 can deform and/or straighten in response to forces $F_L$ and $F_R$, as depicted in the figure, applied to ends 30 and 32 of straight sections 26 and 28, respectively. Conductive wires, especially stranded conductive wires, typically do not offer high resistance to such deformation, and typically provide little return-to-arcuate-form memory. Without an expansion member to prevent arcuate portion 24 from deforming, the deformation of arcuate portion 24 may occur as expandable light strings 12A-12C are being strung about trees and/or shrubs. If such deformation of arcuate portion 24 occurs during such decoration activity, expandable light strings 12A-12C will not readily expand further in response to future tensile forces.

Figure 2B:
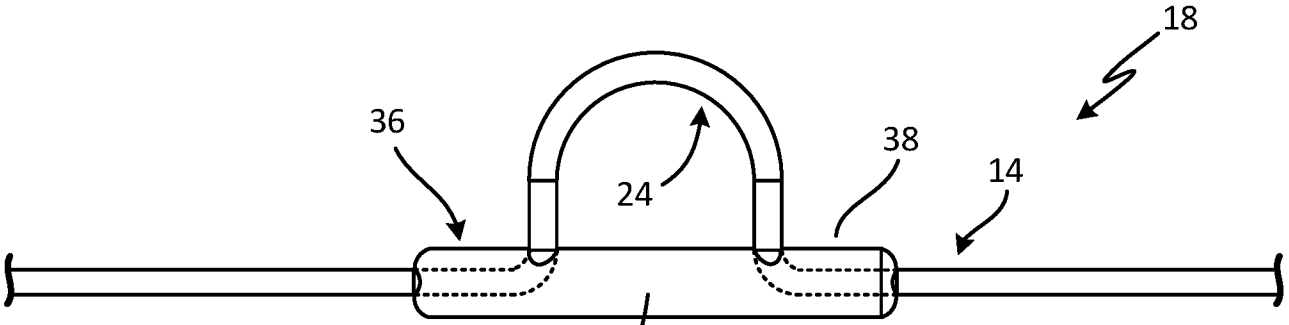
FIGS. 2B-2C are schematic diagrams of an embodiment of an expandable link using the arcuate portion shown in FIG. 2A.
Figure 2C:
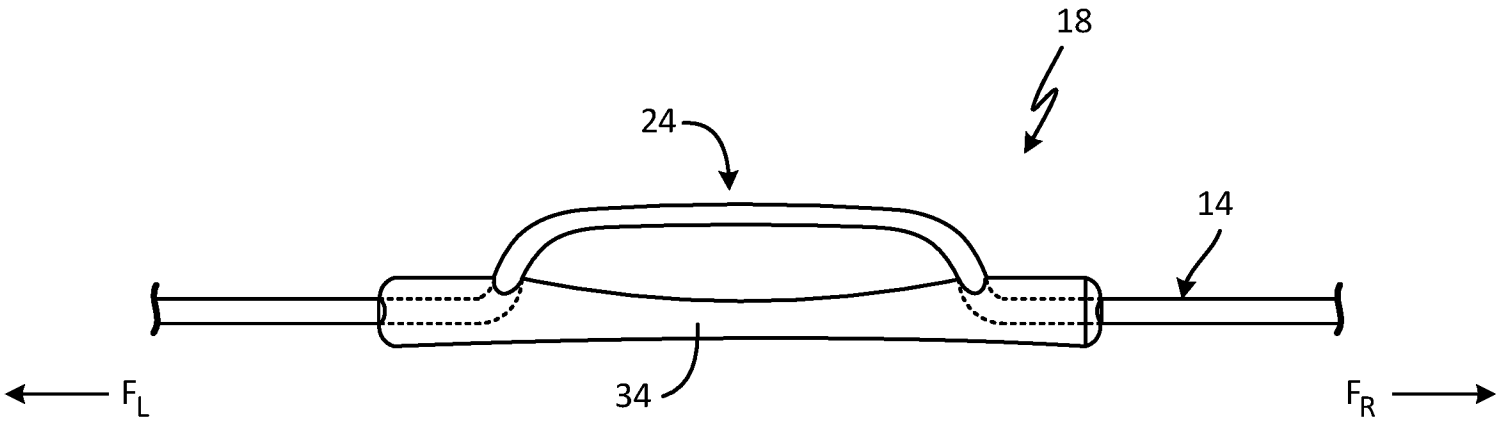

FIGS. 2B-2C are schematic diagrams of an embodiment of an expandable link using the arcuate portion shown in FIG. 2A. In FIG. 2B, expandable link 18 is depicted in its natural state with no tensile forces applied thereto. Expandable link 18 includes a segment of flexible cable 14 and expansion member 34 mechanically engaging the segment of the flexible cable 14 at first and second engagement portions 36 and 38. Expansion member 34 is a longitudinal elastomer having first and second lumens. First engagement portion 36 of the flexible cable 18 is engaged within the first lumen. Second engagement portion 38 of flexible cable 18 is engaged within the second lumen. Expandable link 18 is in a natural state if no tensile force is applied between the first and second engagement portions 36 and 38 as is depicted in FIG. 2B. In its nature state, arcuate portion 24 is in the arcuate form depicted in FIG. 2A.

In FIG. 2C, expandable link 18 is depicted in its expanded state with a tensile force applied thereto. Expandable link 18 includes a segment of flexible cable 14 and expansion member 34 mechanically engaging the segment of the flexible cable 18 at first and second engagement portions 36 and 38. Expandable link 18 is in an expanded state if tensile forces $F_R$ and $F_L$ are applied between the first and second engagement portions 36 and 38 as is depicted in FIG. 2C. Expandable link 18 will be in the expanded state if a tensile force is applied between the first and second engagement portions 36 and 38. In the expanded state, arcuate portion 24 is deformed in an elongate fashion as is depicted in FIG. 2C. Expansion member 34 is configured to permit a separation distance between the adjacent pair of lighting elements, between which expandable link 18 resides, to increase in response to an expansion force therebetween.

In the embodiment depicted in FIGS. 2B and 2C, expansion member 34 is configured to contract in response to a reduction of the tensile force between the first and second engagement portions 36 and 38. Thus, expansion member 34 is configured to permit a separation distance between the adjacent pair of lighting elements, between which expansion link 18 resides, to decrease in response to a reduction of the expansion force.

Figure 3A:
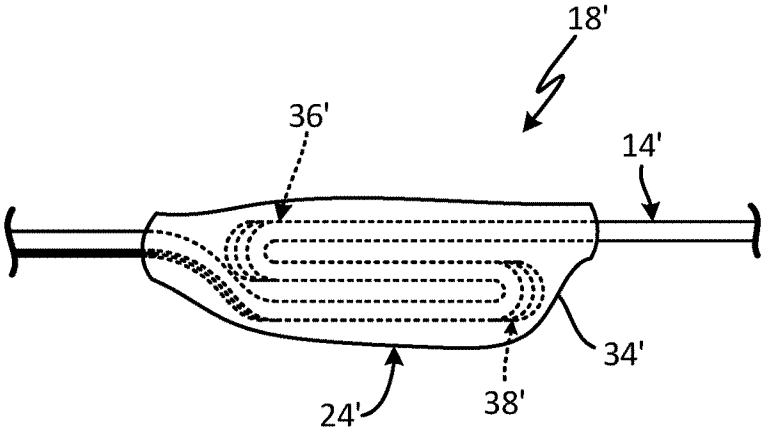
FIGS. 3A-3B are schematic diagram of an embodiment of an expandable link using a flexible cable having an S-shaped arcuate portion.
Figure 3B:
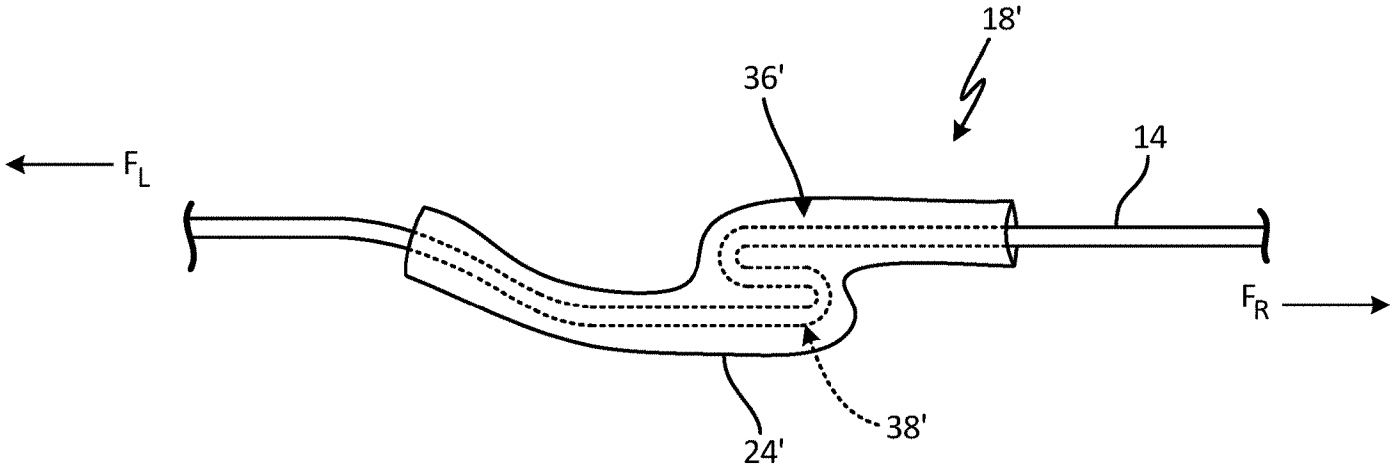

FIGS. 3A-3B are schematic diagrams of an embodiment of an expandable link using a flexible cable having an S-shaped arcuate portion. In FIG. 3A, expandable link 18' is depicted in its natural state with no tensile forces applied thereto. Expansion link 18' includes a segment of flexible cable 14 and expansion member 34' mechanically engaging the segment of flexible cable 14 at first and second engagement portions 36' and 38'. Arcuate portion 24' of flexible cable 14 is between first and second engagement portions 36' and 38'. In response to a tensile force $F_L$ and $F_R$, as depicted in the figure, arcuate portion 24' will release a length of flexible cable 14 from within expansion member 34', thereby decreasing a lateral dimension of S-shaped arcuate portion 24'.

In FIG. 3B, expansion link 18' is depicted in its expanded state with a tensile force applied thereto. Expansion link 18' includes a segment of flexible cable 14 and expansion member 34' mechanically engaging the segment of flexible cable 14 at first and second engagement portions 36' and 38'. Arcuate portion 24' of flexible cable 14 is between first and second engagement portions 36' and 38'. In response to a tensile force $F_L$ and $F_R$, as depicted in the figure, arcuate portion 24' has released a length of flexible cable 14 from within expansion member 34', thereby decreasing a lateral dimension of S-shaped arcuate portion 24. In the embodiment depicted in FIGS. 3A-3B, expansion link 18' is configured to expand in response to a tensile force between first and second engagement portions 36' and 38'. Expansion link 18' is not configured to contract, however, in response to a reduction of the tensile force therebetween.

Various embodiments may use various materials for expansion member 34'. For example, some embodiments may use heatshrink for expansion member 34'. Some embodiments may use an adhesive tape for expansion member 34'. In some embodiments, flexible expansion member 34' may be formed from a cylinder of a plastic material. In some embodiments, expansion member 34' can be substantially flexible, and in other embodiments expansion member 34' can be substantially inflexible.

Figure 4A:
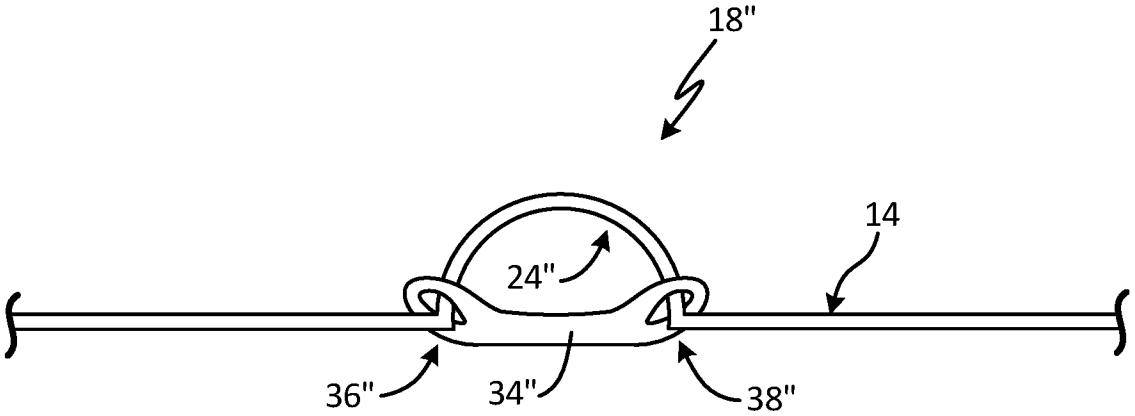
FIG. 4A is a schematic diagram of an embodiment of an expandable link.
Figure 4B:
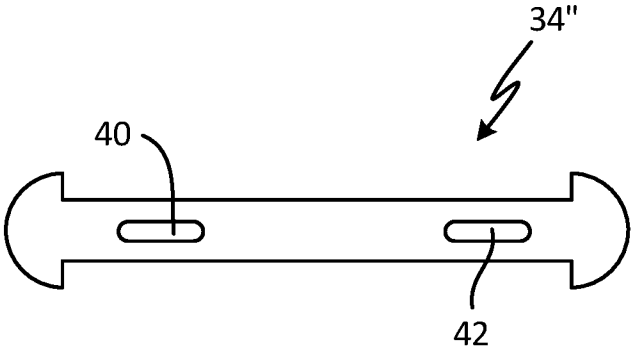
FIG. 4B is a schematic diagram of an embodiment of an expansion member.

FIG. 4A is a schematic diagram of an embodiment of an expandable link. In FIG. 4A, expandable link 18" is depicted in its natural state with no tensile forces applied thereto. Expandable link 18" includes a segment of flexible cable 14 and expansion member 34" mechanically engaging the segment of the flexible cable 14 at first and second engagement portions 36" and 38". Arcuate portion 24" of flexible cable 14 is between first and second engagement portions 36" and 38". FIG. 4B is a schematic diagram of an embodiment of expansion member 34" depicted in FIG. 4A. In FIG. 4B, expansion member 34" includes cable engagement apertures 40 and 42.

Various other embodiments can provide elastic expansion capabilities to a light string. In some embodiments, an expansion member (e.g., expansion member 34') slideably engages a flexible cable (e.g., flexible cable 14). In some embodiments, an expansion member (e.g., expansion members 34 and 34") fixedly couples to flexible cable 18. Various elastomers can be attached to first and second engagement portions of the flexible cable so as to have an arcuate portion (e.g., arcuate portions 34, 34' and 34") of the flexible cable between the first and second engagement portions (e.g., first and second expansion portions 36, 36', 36", 38, 38' and 38"), if the elastomer is in its natural state. Such elastomers and/or expansion members have a spring constant that is less than a spring constant of the flexible cable to which it is attached. For example, various expansion members have a spring constant of less than 200 N/m or 100, 50, 25 or less than 10 N/m or less.

In some embodiments, a ratio of a fully expanded light string to an unexpanded light string can be greater than 1.05, 1.10, 1.15, or greater than 1.25 or more. An unexpanded light string is one in which the light string has not been expanded by a tensile force. A light string is fully expanded if a tensile force greater than a predetermined threshold is applied to the entire plurality of expandable links. The predetermined force can be greater than 5 N, or 7 N, 10 N, 15 N, or more.

Figure 5A:
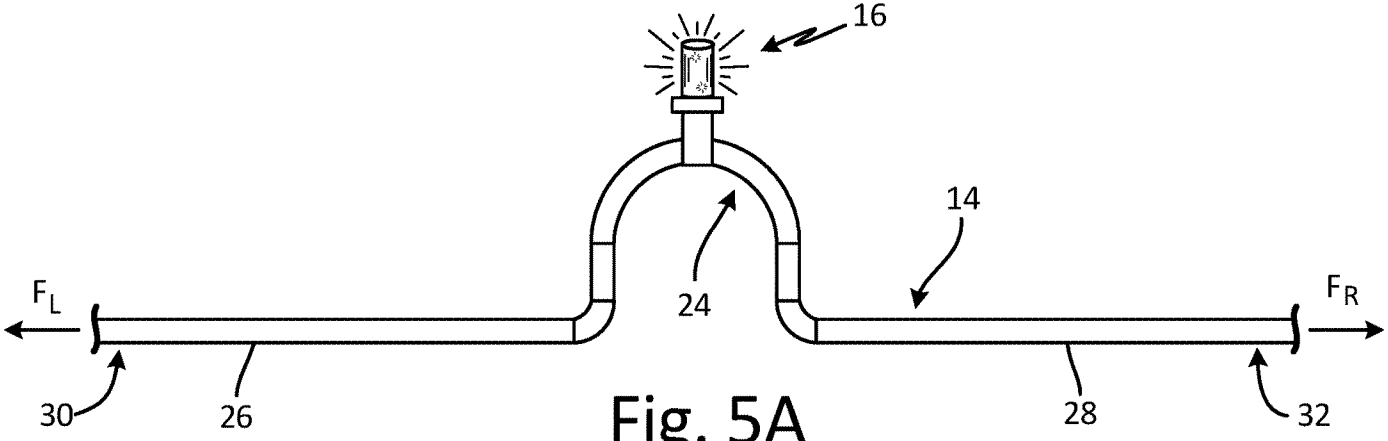
FIG. 5A is a schematic diagram of a flexible cable having an arcuate portion which can expand in response to a tensile force.

FIG. 5A is a schematic diagram of a flexible cable having an arcuate portion which can expand in response to a tensile force. In FIG. 5A, exemplary flexible cable 14 includes arcuate portion 24 and lighting element 16. Arcuate portion 24 connects first straight section 26 and second straight section 28. Arcuate portion 24 can deform and/or straighten in response to forces $F_L$ and $F_R$, as depicted in the figure, applied to ends 30 and 32 of straight sections 26 and 28, respectively. Conductive wires, especially stranded conductive wires, typically do not offer high resistance to such deformation, and typically provide little return-to-arcuate-form memory. Without an expansion member to prevent arcuate portion 24 from deforming, the deformation of arcuate portion 24 may occur as expandable light strings 12A-12C are being strung about trees and/or shrubs. If such deformation of arcuate portion 24 occurs during such decoration activity, expandable light strings 12A-12C will not readily expand further in response to future tensile forces.

Figure 5B:
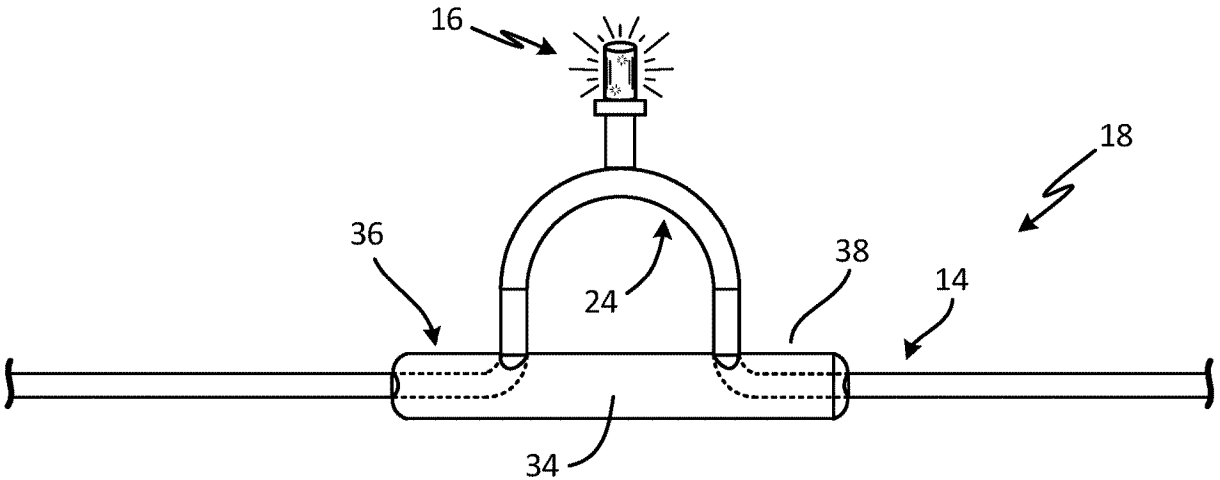
FIGS. 5B-5C are schematic diagrams of an embodiment of an expandable link using the arcuate portion shown in FIG. 5A.
Figure 5C:
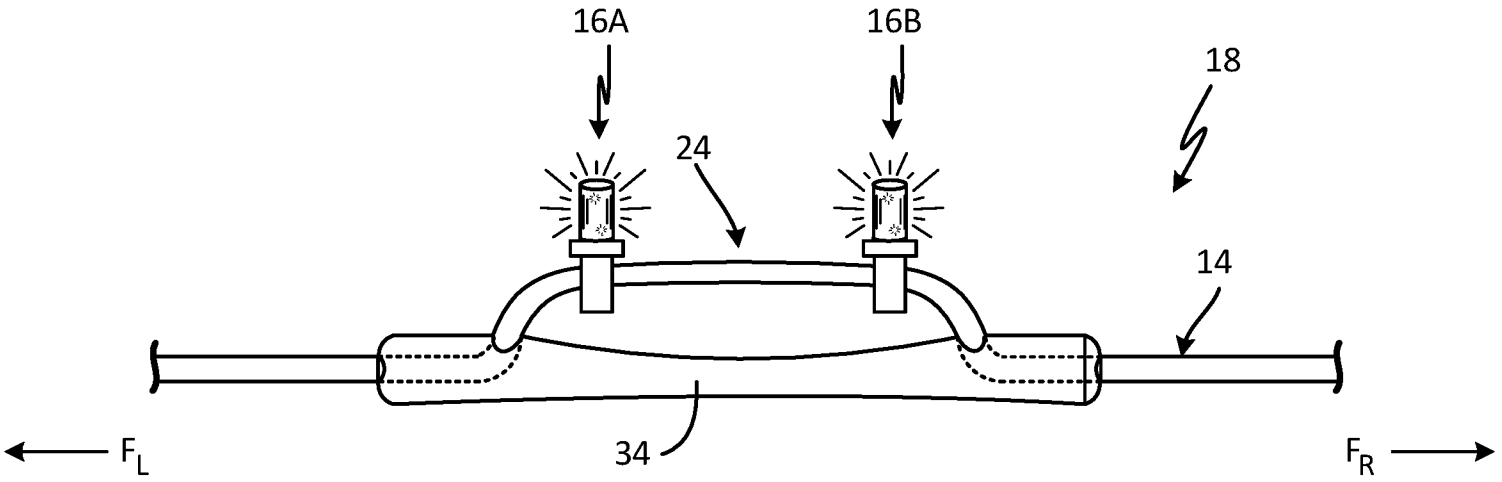

FIGS. 5B-5C are schematic diagrams of an embodiment of an expandable link using the arcuate portion shown in FIG. 5A. In FIG. 5B, expandable link 18 is depicted in its natural state with no tensile forces applied thereto. Expandable link 18 includes a segment of flexible cable 14 and expansion member 34 mechanically engaging the segment of the flexible cable 14 at first and second engagement portions 36 and 38. In the depicted configuration, first and second engagement portions 36 and 38 straddle (i.e., are located on either side of) lighting element 16. Expansion member 34 is a longitudinal elastomer having first and second lumens. First engagement portion 36 of the flexible cable 18 is engaged within the first lumen. Second engagement portion 38 of flexible cable 18 is engaged within the second lumen. Expandable link 18 is in a natural state if no tensile force is applied between the first and second engagement portions 36 and 38 as is depicted in FIG. 2B. In its nature state, arcuate portion 24 is in the arcuate form depicted in FIG. 2A.

In FIG. 5C, expandable link 18 is depicted in its expanded state with a tensile force applied thereto. If the FIG. 5C embodiment, lighting elements 16A and 16B are both affixed to the arcuate portion 24 between engagement portions 36 and 38. Expandable link 18 includes a segment of flexible cable 14 and expansion member 34 mechanically engaging the segment of the flexible cable 18 at first and second engagement portions 36 and 38. In some embodiments, engagement portions 36 and 38 slideably engage flexible cable 18, and are slideabley stopped by lighting elements 16A and 16B. Expandable link 18 is in an expanded state if tensile forces $F_R$ and $F_L$ are applied between the first and second engagement portions 36 and 38 as is depicted in FIG. 2C. Expandable link 18 will be in the expanded state if a tensile force is applied between the first and second engagement portions 36 and 38. In the expanded state, arcuate portion 24 is deformed in an elongate fashion as is depicted in FIG. 2C. Expansion member 34 is configured to permit a separation distance between lighting elements, between which expandable link 18 resides, to increase in response to an expansion force therebetween.

In the embodiment depicted in FIGS. 5B and 5C, expansion member 34 is configured to contract in response to a reduction of the tensile force between the first and second engagement portions 36 and 38. Thus, expansion member 34 is configured to permit a separation distance between lighting elements, between which expansion link 18 resides, to decrease in response to a reduction of the expansion force.

Figure 6:
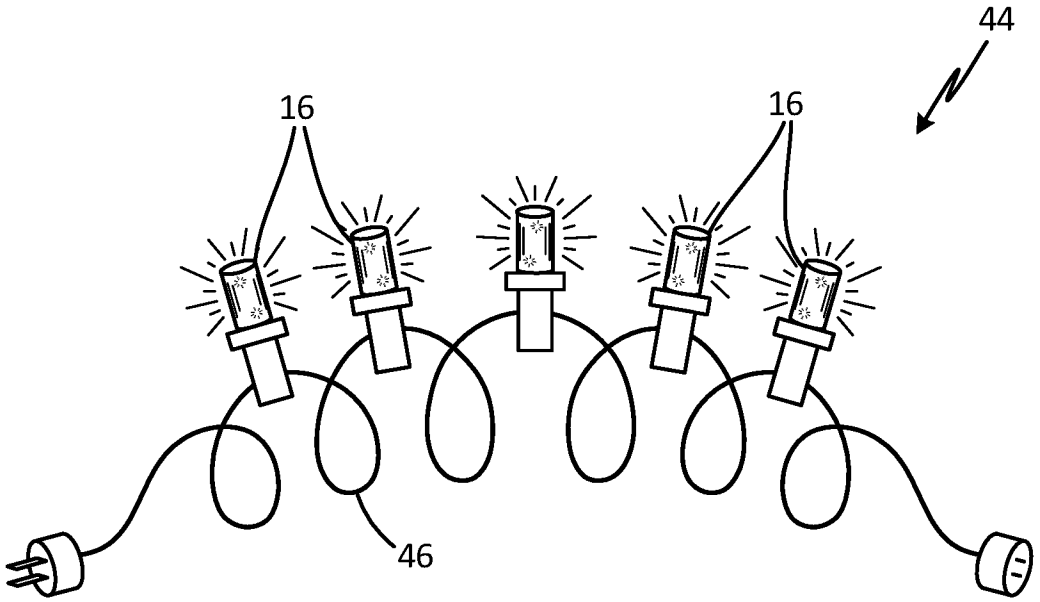
FIG. 6 depicts an embodiment of an expandable light string that has a spring element.

FIG. 6 depicts an embodiment of an expandable light string that has a spring element. In the FIG. 6 embodiment, expandable light string 44 is depicted as having a plurality of lighting elements 16 distributed along coiled power distribution network 46 (e.g. a flexible cable). Coiled power distribution network 46 includes electrical conductors configured to distribute power to the plurality of lighting elements 16 and a coiled spring element configured to permit expansion and contraction of a length of the coiled power distribution network. In some embodiments, the coiled spring element can be a conductive wire that also is used to distribute power to the plurality of lighting elements 16. In some embodiments, a plurality of coiled spring elements can be distributed along the length of power distribution network 46 to provide a plurality of local expansion/contraction members. In such embodiments, a plurality of coiled expansion regions can be distributed along a length of power distribution network 46.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An expandable light string comprising:

a flexible cable having a plurality of conductive wires extending and providing electrical conduction between a first electrical connector at a first end and a complementary second electrical connector at a second end, the first electrical connector configured to receive operating power and the complementary second electrical connector configured to provide operating power;

a plurality of lighting elements distributed on the flexible cable, each of the plurality of lighting elements configured to illuminate in response to receiving operating power from the plurality of conductive wires; and one or more expansion members coupled to the flexible cable, the one or more expansion members configured to expand, in response to a tensile force applied to the first and second ends of the flexible cable, so that a length of the flexible cable between the first and second ends increases, and to contract, in response to a reduction in the tensile force applied to the first and second ends of the flexible cable, so that the length of the flexible cable between the first and second ends decreases.

2. The expandable light string of claim 1, wherein the one or more expansion members includes a spring element.

3. The expandable light string of claim 2, wherein the spring element extends along a majority of the length of the flexible cable.

4. The expandable light string of claim 1, wherein the one or more expansion members includes a plurality of spring elements.

5. The expandable light string of claim 1, wherein each of the one or more expansion members mechanically engage the flexible cable at first and second engagement portions, wherein the expansion member maintains the flexible cable in an arcuate form between the first and the second engagement portions if no expansion force is applied therebetween.

6. The expandable light string of claim 5, wherein at most only one of the plurality of lighting elements is between the first and second engagement portions of each of the expansion members.

7. The expandable light string of claim 5, wherein at least one of the plurality of lighting elements is between the first and second engagement portions of each of the expansion members.

8. The expandable light string of claim 5, wherein the arcuate shape of the flexible cable between the first and the second engagement portions changes shape in response to the expansion force therebetween.

9. The expandable light string of claim 1, wherein the one or more expansion members includes an elastomer having a spring constant that is less than 100 N/m.

10. The expandable light string of claim 1, wherein the expandable light string has an unexpanded length and a fully expanded length, wherein a ratio of the fully expanded length to the unexpanded length is greater than 1.05.

11. An expandable light string comprising:

a flexible cable having a plurality of conductive wires extending and providing electrical conduction between a first electrical connector at a first end and a complementary second electrical connector at a second end, the first electrical connector configured to receive operating power and the complementary second electrical connector configured to provide operating power;

a plurality of lighting elements distributed on the flexible cable, each of the plurality of lighting elements configured to illuminate in response to receiving operating power from the plurality of conductive wires; and one or more expandable links, each comprising a segment of the flexible cable and an expansion member mechanically engaging the segment of the flexible cable, wherein each of the one or more expandable links is in a natural state if no tensile force is applied between opposite ends of the expandable link and in an expanded state if a tensile force is applied between the opposite ends of the expandable link, wherein, in the natural state, the expansion member maintains the flexible cable in an arcuate form between the first and the second engagement portions.

12. The expandable light string of claim 11, wherein each of the one or more expandable links includes a spring element.

13. The expandable light string of claim 12, wherein the spring element extends along a majority of the length of the expandable link corresponding to the spring element.

14. The expandable light string of claim 11, wherein the one or more expandable link are each connected to a spring element that extends along a majority of a length of the flexible cable.

15. The expandable light string of claim 11, wherein each of the expansion members mechanically engages the segment of the flexible cable at first and second engagement portions.

16. The expandable light string of claim 15, wherein only one of the plurality of lighting elements is between the first and second engagement portions of each of the plurality of expansion members.

17. The expandable light string of claim 15, wherein at least one of the plurality of lighting elements is between the first and second engagement portions of each of the plurality of expansion members.

18. The expandable light string of claim 11, wherein, in the natural state, the adjacent pair of lighting elements have a separation distance less than a predetermined threshold, and the expanded state, the adjacent pair of lighting elements have a separation distance greater than the predetermined threshold.

19. The expandable light string of claim 11, wherein the expansion member includes an elastomer having a spring constant that is less than 100 N/m.

20. The expandable light string of claim 11, wherein the expandable light string has an unexpanded length and a fully expanded length, wherein a ratio of the fully expanded length to the unexpanded length is greater than 1.05.

* * * * *